US008295755B2

(12) United States Patent
Shono et al.

(10) Patent No.: US 8,295,755 B2
(45) Date of Patent: Oct. 23, 2012

(54) GLOSS APPLICATION SHEET FOR APPLYING A UNIFORMED GLOSS TO A TONER IMAGE ON A RECORDING MEDIUM

(75) Inventors: Hidekazu Shono, Takarazuka (JP); Shuuichi Nakagawa, Suita (JP); Tomofumi Inoue, Toyonaka (JP)

(73) Assignee: Ricoh Company, Ltd., Tokyo (JP)

( * ) Notice: Subject to any disclaimer, the term of this patent is extended or adjusted under 35 U.S.C. 154(b) by 137 days.

(21) Appl. No.: 12/823,520

(22) Filed: Jun. 25, 2010

(65) Prior Publication Data

US 2011/0013958 A1 Jan. 20, 2011

(30) Foreign Application Priority Data

Jul. 14, 2009 (JP) ..... 2009-165863

(51) Int. Cl.
*G03G 15/20* (2006.01)

(52) U.S. Cl. ..... 399/341

(58) Field of Classification Search ..... 399/341, 399/342; 428/32.13, 32.14, 32.15; 283/109, 283/110

See application file for complete search history.

(56) References Cited

U.S. PATENT DOCUMENTS 5,392,104 A * 2/1995 Johnson ..... 399/301

FOREIGN PATENT DOCUMENTS

| | | | |
|---|---|---|---|
| JP | 48-94438 | | 12/1973 |
| JP | 5-21260 | | 3/1993 |
| JP | 2511826 | | 4/1996 |
| JP | 2000112168 | A * | 4/2000 |
| JP | 2004191678 | A * | 7/2004 |
| JP | 2008-20520 | | 1/2008 |
| JP | 2008-51857 | | 3/2008 |

* cited by examiner

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

When a gloss application sheet is conveyed through a nip formed between a first nip formation member and a second nip formation member pressing against each other, the gloss application sheet is sandwiched between the first nip formation member and a recording medium simultaneously conveyed through the nip. The gloss application sheet includes a first contact surface contacting the first nip formation member and a second contact surface disposed opposite the first contact surface for contacting the recording medium. The first contact surface has a reduced adhesive force compared to the second contact surface.

17 Claims, 3 Drawing Sheets

GLOSS APPLICATION SHEET FOR APPLYING A UNIFORMED GLOSS TO A TONER IMAGE ON A RECORDING MEDIUM

CROSS-REFERENCE TO RELATED APPLICATIONS

The present application is based on and claims priority to Japanese Patent Application No. 2009-165863, filed on Jul. 14, 2009 in the Japan Patent Office, which is hereby incorporated herein by reference in its entirety.

BACKGROUND OF THE INVENTION

1. Field of the Invention

Exemplary aspects of the present invention relate to a gloss application sheet and an image forming apparatus, and more particularly, to a gloss application sheet overlaid on a recording medium bearing a toner image, and an image forming apparatus using the gloss application sheet.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

In such fixing device, a heating roller and a pressing roller pressed against each other apply heat and pressure to a recording medium bearing an unfixed toner image as the heating roller and the pressing roller nip and convey the recording medium. Thus, the heat and the pressure fix the toner image on the recording medium. Specifically, the heating roller contacts the unfixed toner image on the recording medium to melt the toner. Accordingly, the melted toner, which contains resin to facilitate melting, may adhere to the surface of the heating roller. When the resin in the toner adhered to the heating roller solidifies, the solidified resin may generate asperities on the surface of the heating roller. Consequently, when the heating roller having such surface asperities contacts the unfixed toner image on the recording medium to fix the unfixed toner image, the surface asperities of the heating roller may generate asperities on the fixed toner image. As a result, the fixed toner image may not have the requisite gloss.

Further, when the recording medium bearing the melted toner image is separated from the heating roller, the surface of the toner image is roughened. Accordingly, the toner image may not have the requisite gloss.

To address those problems, a gloss application sheet may be overlaid on the image side of the recording medium which bears the unfixed toner image, so that the heating roller applies heat to the unfixed toner image on the recording medium via the gloss application sheet to melt the unfixed toner image. Thus, the smooth surface of the gloss application sheet flattens and smoothes the surface of the toner image. Thereafter, when the toner image is cooled and solidified, the gloss application sheet is separated from the recording medium. As a result, the toner image has a uniform gloss.

Use of such gloss application sheet involves heat being transmitted from the heating roller to the unfixed toner image on the recording medium via the gloss application sheet. Accordingly, the thinner the gloss application sheet the more effectively it transmits heat. However, a thinner gloss application sheet may have decreased rigidity, and therefore may be more easily wound around the heating roller. Consequently, the gloss application sheet may not be adhered to the recording medium properly, resulting in uneven gloss of the toner image fixed on the recording medium.

BRIEF SUMMARY OF THE INVENTION

This specification describes below a gloss application sheet according to exemplary embodiments of the present invention. In one exemplary embodiment of the present invention, when a gloss application sheet is conveyed through a nip formed between a first nip formation member and a second nip formation member pressing against each other in an image forming apparatus, the gloss application sheet is sandwiched between the first nip formation member and a recording medium simultaneously conveyed through the nip. The gloss application sheet includes a first contact surface that contacts the first nip formation member and a second contact surface disposed opposite the first contact surface for contacting the recording medium. The first contact surface has a reduced adhesive force compared to the second contact surface.

This specification describes below an image forming apparatus according to exemplary embodiments of the present invention. In one exemplary embodiment of the present invention, the image forming apparatus includes a fixing device that fixes a toner image on a recording medium, and a sheet supplier that supplies a gloss application sheet to the fixing device. The fixing device includes a first nip formation member and a second nip formation member. The first nip formation member applies heat to the recording medium bearing the toner image. The second nip formation member presses against the first nip formation member to form a nip between the first nip formation member and the second nip formation member. The sheet supplier supplies the gloss application sheet between the first nip formation member and the recording medium conveyed through the nip. The gloss application sheet includes a first contact surface that contacts the first nip formation member and a second contact surface disposed opposite the first contact surface for contacting the recording medium. The first contact surface has a reduced adhesive force compared to the second contact surface.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
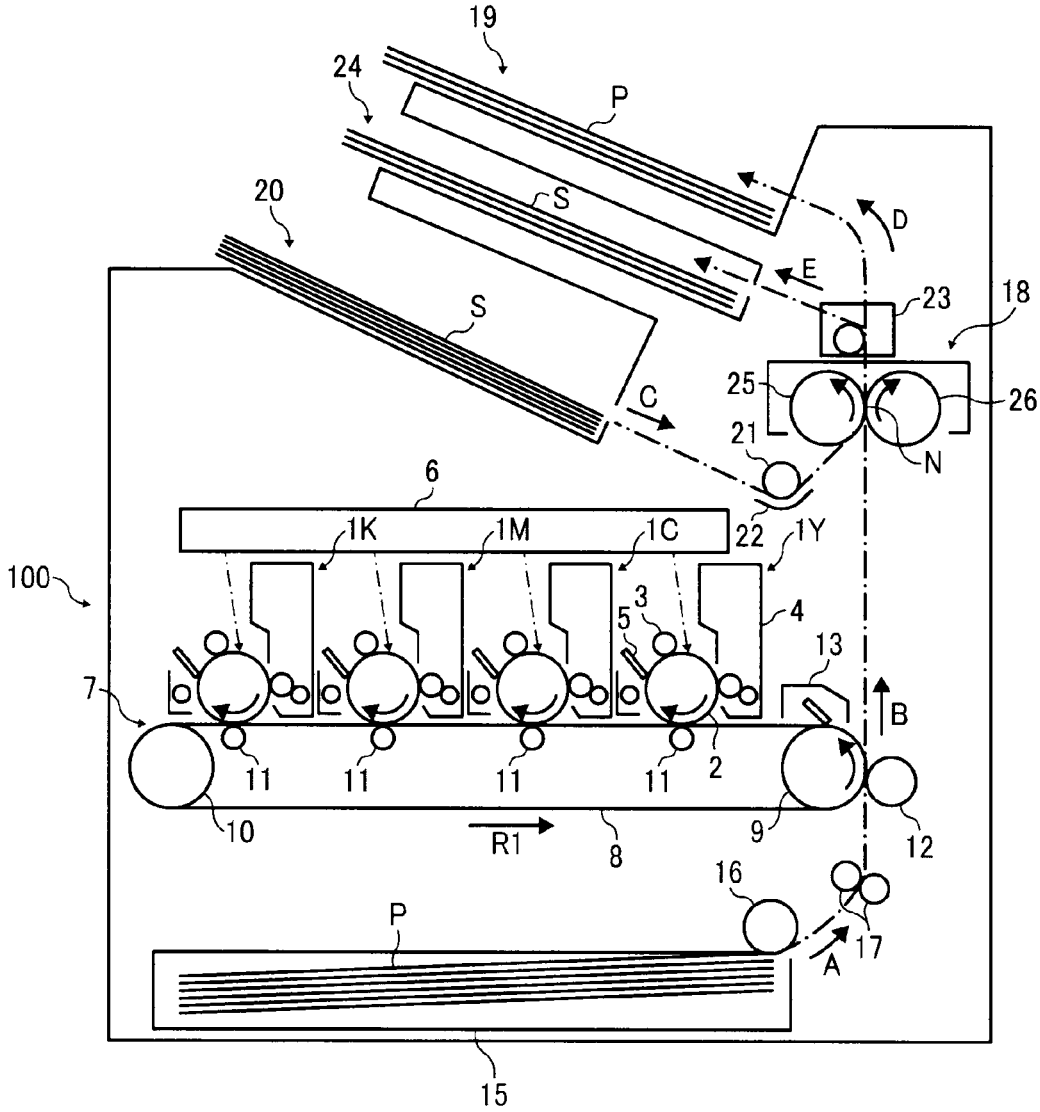
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

FIG. 1 is a schematic view of the image forming apparatus 100. As illustrated in FIG. 1, the image forming apparatus 100 includes process units 1Y, 1C, 1M, and 1K, an exposure device 6, a transfer device 7, a second transfer roller 12, a belt cleaner 13, a paper tray 15, a feed roller 16, a registration roller pair 17, a fixing device 18, an output tray 19, a sheet container 20, a sheet conveyance roller 21, a guide 22, a sheet separator 23, and a sheet collector 24.

The process units 1Y, 1C, 1M, and 1K include photoconductors 2, charging rollers 3, development devices 4, and cleaning blades 5, respectively. The transfer device 7 includes an intermediate transfer belt 8, a driving roller 9, a driven roller 1C, and first transfer rollers 11. The fixing device 18 includes a heating roller 25 and a pressing roller 26.

Figure 2:
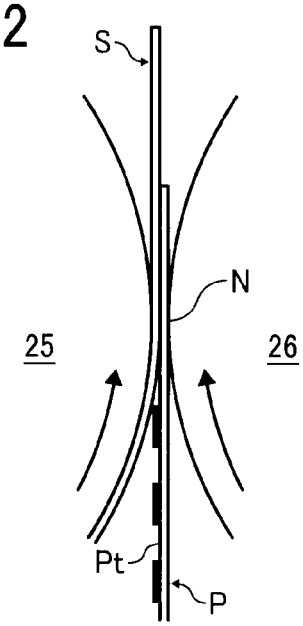
FIG. 2 is a partial sectional view of a heating roller and a pressing roller of a fixing device included in the image forming apparatus shown in FIG. 1.

FIG. 2 is a partial sectional view of the heating roller 25 and the pressing roller 26.

As illustrated in FIG. 1, the image forming apparatus 100 may be a copier, a facsimile machine, a printer, a multifunction printer having at least one of copying, printing, scanning, plotter, and facsimile functions, or the like. According to this exemplary embodiment of the present invention, the image forming apparatus 100 is a tandem color printer for forming a color image on a recording medium.

The image forming apparatus 100 includes four process units 1Y, 1C, 1M, and 1K, each of which is detachably attached to the image forming apparatus 100. The process units 1Y, 1C, 1M, and 1K have an identical structure except that the process units 1Y, 1C, 1M, and 1K contain toner in different colors (e.g., yellow, cyan, magenta, and black) corresponding to color separation components of a color image, respectively.

Each of the process units 1Y, 1C, 1M, and 1K includes the photoconductor 2 serving as an image carrier, the charging roller 3 serving as a charger for charging a surface of the photoconductor 2, the development device 4 serving as a development device for developing an electrostatic latent image formed on the surface of the photoconductor 2 into a toner image, and the cleaning blade 5 serving as a cleaner for cleaning the surface of the photoconductor 2.

The exposure device 6 is provided above the process units 1Y, 1C, 1M, and 1K, and emits laser beams onto the surfaces of the photoconductors 2 of the process units 1Y, 1C, 1M, and 1K, respectively. The transfer device 7 is provided below the process units 1Y, 1C, 1M, and 1K. In the transfer device 7, the intermediate transfer belt 8 serves as an endless belt stretched over the driving roller 9 and the driven roller 1C to rotate in a rotation direction R1.

The four first transfer rollers 11 serving as first transfer members face the four photoconductors 2, respectively. The first transfer rollers 11 contact an inner circumferential surface of the intermediate transfer belt 8, and press against the photoconductors 2 via the intermediate transfer belt 8 at positions opposing the photoconductors 2, respectively. Thus, first transfer nips are formed between the photoconductors 2 and the intermediate transfer belt 8 at the positions at which the first transfer rollers 11 press against the photoconductors 2 via the intermediate transfer belt 8, respectively.

The second transfer roller 12 serves as a second transfer member disposed opposite the driving roller 9. The second transfer roller 12 contacts an outer circumferential surface of the intermediate transfer belt 8, and presses against the driving roller 9 via the intermediate transfer belt 8. Thus, a second transfer nip is formed between the second transfer roller 12 and the intermediate transfer belt 8 at a position at which the second transfer roller 12 presses against the driving roller 9 via the intermediate transfer belt 8. The belt cleaner 13 faces and cleans the outer circumferential surface of the intermediate transfer belt 8.

The paper tray 15, the feed roller 16, and the registration roller pair 17 are provided in a lower portion of the image forming apparatus 100. The paper tray 15 contains recording sheets P serving as recording media. The feed roller 16 picks up and feeds a recording sheet P from the paper tray 15. The registration roller pair 17 conveys the recording sheet P sent from the paper tray 15 by the feed roller 16 to the second transfer nip formed between the second transfer roller 12 and the intermediate transfer belt 8 at a proper time.

The recording medium used in the image forming apparatus 100 may be an overhead projector (OHP) transparency or any medium onto which the toner image can be transferred.

The fixing device 18 for fixing a toner image on the recording sheet P, and the output tray 19 for receiving and stocking the recording sheet P discharged to an outside of the image forming apparatus 100 after a fixing process are provided in an upper portion of the image forming apparatus 100. Further, the sheet container 20, the sheet conveyance roller 21, the guide 22, the sheet separator 23, and the sheet collector 24 are provided in the upper portion of the image forming apparatus 100. The sheet container 20 contains gloss application sheets S. The sheet conveyance roller 21 serving as a sheet supplier conveys a gloss application sheet S sent from the sheet container 20 to the fixing device 18. The guide 22 guides the gloss application sheet S conveyed by the sheet conveyance roller 21. The sheet separator 23 separates the gloss application sheet S from the recording sheet P. The sheet collector 24 collects the separated gloss application sheet S.

The fixing device 18 includes the heating roller 25 and the pressing roller 26 which serve as a pair of nip formation members for forming a fixing nip N by contacting each other. Alternatively, a rotary member such as a belt or a non-rotary member may be used as a nip formation member.

A heat source such as a halogen lamp is provided inside the heating roller 25. The pressing roller 26 contacts and presses against the heating roller 25 with predetermined pressure to form the fixing nip N. A driver rotates the heating roller 25, and the rotating heating roller 25 rotates the pressing roller 26. In other words, the pressing roller 26 is driven by the rotating heating roller 25.

The heating roller 25 includes a cylindrical member, an elastic layer, and a releasing layer. The elastic layer covers a surface of the cylindrical member, and the releasing layer covers a surface of the elastic layer. The cylindrical member may include a metal material (e.g., aluminum) having a desired mechanical strength and a proper thermal conductivity. However, the metal material included in the cylindrical member is not limited to aluminum. For example, the cylindrical member may include metal such as stainless steel, steel, and brass, and/or an alloy of those having a desired mechanical strength and a proper thermal conductivity.

The elastic layer of the heating roller 25 may include an elastic material such as silicon rubber. Alternatively, the elastic layer of the heating roller 25 may include any material having heat resistance such as fluorocarbon rubber. A method for covering the surface of the cylindrical member with the elastic layer is not limited. For example, the elastic layer may cover the surface of the cylindrical member by injection molding or coating.

The releasing layer of the heating roller 25 may include tetrafluoroethylene-perfluoroalkylvinylether copolymer (PFA). Alternatively, the releasing layer may include any material having heat resistance and proper releasing property for releasing toner from the heating roller 25 such as fluorocarbon rubber and fluorocarbon resin.

Like the heating roller 25, the pressing roller 26 includes a cylindrical member, an elastic layer, and a releasing layer. The cylindrical member includes metal such as aluminum. The elastic layer covers a surface of the cylindrical member and includes silicon rubber. The releasing layer including PFA covers a surface of the elastic layer.

Referring to FIG. 1, the following describes basic operations of the image forming apparatus 100.

When a driver drives and rotates the photoconductors 2 of the process units 1Y, 1C, 1M, and 1K clockwise in FIG. 1, the charging rollers 3 uniformly charge the surfaces of the photoconductors 2 to have a predetermined polarity, respectively. The exposure device 6 emits laser beams onto the charged surfaces of the photoconductors 2 according to image data to form electrostatic latent images on the surfaces of the photoconductors 2, respectively. The image data may be monochrome image data obtained by resolving a desired full-color image into yellow, cyan, magenta, and black data. The development devices 4 supply yellow, cyan, magenta, and black toner to the electrostatic latent images formed on the photoconductors 2 to make the electrostatic latent images visible as yellow, cyan, magenta, and black toner images, respectively.

When the driver drives and rotates the driving roller 9 counterclockwise in FIG. 1, the rotating driving roller 9 rotates the intermediate transfer belt 8 in the rotation direction R1. A voltage controlled to have a constant voltage or a constant current of a polarity opposite to a polarity of charged toner is applied to the first transfer rollers 11 to generate a transfer electric field at the first transfer nips formed between the first transfer rollers 11 and the photoconductors 2, respectively. The transfer electric field generated at the first transfer nips transfers the yellow, cyan, magenta, and black toner images formed on the photoconductors 2 onto the intermediate transfer belt 8 sequentially in such a manner that the yellow, cyan, magenta, and black toner images are superimposed on a same position on the intermediate transfer belt 8. Thus, the outer circumferential surface of the intermediate transfer belt 8 carries a color toner image.

After the transfer of the yellow, cyan, magenta, and black toner images, the cleaning blades 5 remove residual toner not transferred onto the intermediate transfer belt 8 and therefore remaining on the surfaces of the photoconductors 2 from the surfaces of the photoconductors 2, respectively. Dischargers discharge the surfaces of the photoconductors 2 to initialize the surface potential of the photoconductors 2 so that the photoconductors 2 are ready for a next image forming operation.

The feed roller 16 rotates and feeds a recording sheet P contained in the paper tray 15 in a direction A toward the registration roller pair 17. The registration roller pair 17 sends the recording sheet P to the second transfer nip formed between the second transfer roller 12 and the intermediate transfer belt 8 at a proper time. A transfer voltage of a polarity opposite to a polarity of the charged toner of the color toner image formed on the intermediate transfer belt 8 is applied to the second transfer roller 12 to generate a transfer electric field at the second transfer nip. The transfer electric field generated at the second transfer nip transfers the color toner image formed on the intermediate transfer belt 8 onto the recording sheet P at a time. The recording sheet P bearing the color toner image is conveyed from the second transfer nip toward the fixing device 18 in a direction B. After the transfer of the color toner image from the intermediate transfer belt 8 onto the recording sheet P, the belt cleaner 13 removes residual toner remaining on the intermediate transfer belt 8 from the intermediate transfer belt 8.

On the other hand, a gloss application sheet S is conveyed from the sheet container 20 toward the sheet conveyance roller 21 in a direction C. The sheet conveyance roller 21 rotates and feeds the gloss application sheet S toward the fixing device 18. According to this exemplary embodiment, the gloss application sheet S enters the fixing nip N slightly before the recording sheet P enters the fixing nip N.

The gloss application sheet S and the recording sheet P enter the fixing nip N formed between the heating roller 25 and the pressing roller 26 in a state in which the gloss application sheet S is overlaid on the recording sheet P. Specifically, the gloss application sheet S is sandwiched between a surface of the heating roller 25 and an image side Pt of the recording sheet P which bears an unfixed toner image as illustrated in FIG. 2.

The rotating heating roller 25 and the rotating pressing roller 26 convey the gloss application sheet S and the recording sheet P while applying heat and pressure to the gloss application sheet S and the recording sheet P to heat and melt the toner image on the recording sheet P. Thereafter, when the toner is cooled and solidified, the sheet separator 23 separates the gloss application sheet S from the recording sheet P. Accordingly, a smooth surface of the gloss application sheet S smoothes a surface of the toner image on the recording sheet P to cause the toner image to have high gloss uniformly.

When the gloss application sheet S and the recording sheet P are discharged from the fixing device 18, the sheet separator 23 separates the gloss application sheet S from the recording sheet P. Thereafter, the recording sheet P separated from the gloss application sheet S is conveyed in a direction D, and is discharged onto the output tray 19. On the other hand, the gloss application sheet S separated from the recording sheet P is conveyed in a direction E, and is discharged onto the sheet collector 24.

The above describes an image forming operation for foaming a full-color toner image on a recording sheet P. Alternatively, one of the four process units 1Y, 1C, 1M, and 1K may be used to form a monochrome toner image. Yet alternatively, two or three of the four process units 1Y, 1C, 1M, and 1K may be used to form a two-color toner image or a three-color toner image, respectively.

A gloss application sheet S may be selectively supplied to the fixing device 18 whenever a recording sheet P is conveyed through the fixing device 18 as gloss application to the toner image is needed. For example, when gloss application is needed for photo printing, a gloss application sheet S may be supplied to the fixing device 18 so that the gloss application sheet S is overlaid on the image side Pt of the recording sheet P which bears the toner image, and the toner image is fixed on the recording sheet P as described above. Thus, the glossy toner image may be formed. By contrast, when gloss application is not needed for text printing, a gloss application sheet S may not be supplied to the fixing device 18 and therefore only a recording sheet P may be sent to the fixing device 18. Thereafter, a toner image may be fixed on the recording sheet P. Namely, the gloss application sheet S is supplied to the fixing device 18 as needed, minimizing usage of the gloss application sheets S.

The following describes the structure of the gloss application sheet S used in the image forming apparatus 100.

As illustrated in FIG. 2, when the gloss application sheet S is supplied to the fixing nip N, the gloss application sheet S is sandwiched between the surface of the heating roller 25 and the image side Pt of the recording sheet P. In other words, one side of the gloss application sheet S, that is, a first contact surface of the gloss application sheet S, contacts the surface of the heating roller 25. The first contact surface of the gloss application sheet S is processed to reduce an adhesive force which adheres the gloss application sheet S to the heating roller 25.

Figure 3:
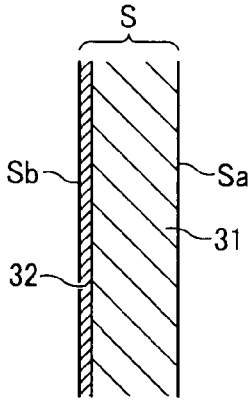
FIG. 3 is an enlarged sectional view of a gloss application sheet used in the image forming apparatus shown in FIG. 1 according to an exemplary embodiment of the present invention.

FIG. 3 is an enlarged sectional view of a gloss application sheet S according to one embodiment. As illustrated in FIG. 3, the gloss application sheet S includes a base layer 31, a releasing layer 32, and contact surfaces Sa and Sb.

The contact surface Sb of the gloss application sheet S, which is provided on the left side of the gloss application sheet S in FIG. 3, contacts the heating roller 25 depicted in FIG. 2. Thus, the contact surface Sb serves as a first contact surface contacting the heating roller 25. The contact surface Sa of the gloss application sheet S, which is provided on the right side of the gloss application sheet S in FIG. 3, contacts the image side Pt of the recording sheet P depicted in FIG. 2 which bears a toner image. Thus, the contact surface Sa serves as a second contact surface contacting the toner image on the recording sheet P.

The releasing layer 32 includes the contact surface Sb to reduce the adhesive force which adheres the gloss application sheet S to the heating roller 25. The releasing layer 32 is provided only on one side of the base layer 31. In other words, the releasing layer 32 is not provided on an opposite side of the base layer 31.

The base layer 31 may be a sheet having a thickness of about 25 μm and including a heat-resistant material suppressing fusion of toner, such as polyester (PET). However, the material of the base layer 31 is not limited to such material.

The releasing layer 32 includes a fluorocarbon material. According to this exemplary embodiment, polytetrafluoroethylene (PTFE) is used as the fluorocarbon material. Alternatively, the releasing layer 32 may include other fluorocarbon materials such as tetrafluoroethylene perfluoroalkylvinylether copolymer (PFA), tetrafluoroethylene hexafluoropropylene copolymer (FEP), and tetrafluoroethylene ethylene copolymer (ETFE) to provide effects equivalent to the effects provided by PTFE. Yet alternatively, the releasing layer 32 may include a silicon material instead of the fluorocarbon material.

According to this exemplary embodiment, the releasing layer 32 of the gloss application sheet S includes the contact surface Sb contacting the heating roller 25 to improve releasing property of the gloss application sheet S for separating from the heating roller 25. Accordingly, the gloss application sheet S is not adhered to the heating roller 25. Consequently, when the gloss application sheet S is discharged from the fixing nip N, the gloss application sheet S separates from the heating roller 25 easily. Thus, the gloss application sheet S is not wound around the heating roller 25. By contrast, the gloss application sheet S is adhered to the recording sheet P properly until the sheet separator 23 depicted in FIG. 1 separates the gloss application sheet S from the recording sheet P.

Figure 4:
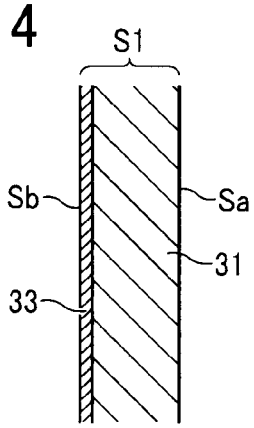
FIG. 4 is an enlarged sectional view of a gloss application sheet according to another exemplary embodiment of the present invention.

Referring to FIG. 4, the following describes a gloss application sheet S1 according to another exemplary embodiment. FIG. 4 is an enlarged sectional view of the gloss application sheet S1. As illustrated in FIG. 4, the gloss application sheet S1 includes the base layer 31 and a conductive layer 33. The base layer 31 includes the contact surface Sa. The conductive layer 33 includes the contact surface Sb.

The conductive layer 33 includes the contact surface Sb contacting the heating roller 25 to reduce the adhesive force which adheres the gloss application sheet S1 to the heating roller 25. By contrast, the conductive layer 33 does not include the contact surface Sa for contacting the image side Pt of the recording sheet P. The conductive layer 33 is formed by providing a thin conductive film such as an indium tin oxide (ITO) film on one side of the base layer 31 or by metal-evaporating with aluminum. The material of the conductive layer 33 and the method for forming the conductive layer 33 may be changed as needed.

According to this exemplary embodiment, the conductive layer 33 of the gloss application sheet S1 includes the contact surface Sb contacting the heating roller 25 to reduce an electrostatic adhesive force generated between the heating roller 25 and the gloss application sheet S1. Accordingly, when the gloss application sheet S1 is discharged from the fixing nip N, the gloss application sheet S1 separates from the heating roller 25 easily. Thus, the gloss application sheet S1 is not wound around the heating roller 25. By contrast, the gloss application sheet S1 is adhered to the recording sheet P properly until the sheet separator 23 separates the gloss application sheet S1 from the recording sheet P.

Figure 5:
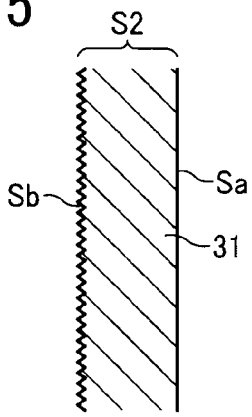
FIG. 5 is an enlarged sectional view of a gloss application sheet according to yet another exemplary embodiment of the present invention.

Referring to FIG. 5, the following describes a gloss application sheet S2 according to yet another exemplary embodiment. FIG. 5 is an enlarged sectional view of the gloss application sheet S2. As illustrated in FIG. 5, the gloss application sheet S2 includes the base layer 31 including the contact surfaces Sa and Sb.

One side of the base layer 31 is blast-finished to reduce the adhesive force which adheres the gloss application sheet S2 to the heating roller 25. The blast finishing generates the rough contact surface Sb of the gloss application sheet S2 for contacting the heating roller 25. By contrast, the contact surface Sa of the gloss application sheet S2 which contacts the image side Pt of the recording sheet P is not blast-finished. In other words, a surface roughness of the contact surface Sb contacting the heating roller 25 is greater than a surface roughness of the contact surface Sa contacting the recording sheet P.

The rough contact surface Sb of the gloss application sheet S2 which contacts the heating roller 25 improves releasing property of the gloss application sheet S2 for separating from the heating roller 25. Accordingly, the gloss application sheet S2 is not adhered to the heating roller 25. Consequently, the gloss application sheet S2 separates from the heating roller 25 easily. Thus, the gloss application sheet S2 is not wound around the heating roller 25. By contrast, the gloss application sheet S2 is adhered to the recording sheet P properly until the sheet separator 23 separates the gloss application sheet S2 from the recording sheet P.

Figure 6:
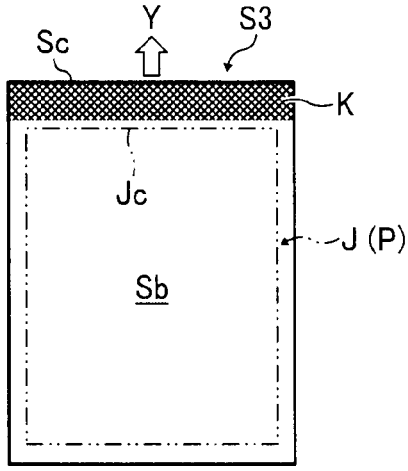
FIG. 6 is a plan view of a gloss application sheet according to yet another exemplary embodiment of the present invention.

Referring to FIG. 6, the following describes a gloss application sheet S3 according to yet another exemplary embodiment. FIG. 6 is a plan view of the gloss application sheet S3.

In FIG. 6, an overlay area J enclosed and defined by broken lines shows an area in which the recording sheet P is overlaid on the gloss application sheet S3 when the gloss application sheet S3 is supplied to the fixing nip N. In other words, the gloss application sheet S3 is larger in size than the recording sheet P both in a horizontal direction and a vertical direction. Also in other exemplary embodiments of this specification, the gloss application sheet S3 may be larger in size than the recording sheet P. The gloss application sheet S3 is conveyed toward the fixing nip N in a sheet conveyance direction Y.

In the gloss application sheet S3 also, the contact surface Sb is processed to reduce the adhesive force which adheres the gloss application sheet S3 to the heating roller 25. Accordingly, as in the above-described exemplary embodiments, the gloss application sheet S3 is not wound around the heating roller 25. For example, the gloss application sheet S3 may be processed to reduce the adhesive force which adheres the gloss application sheet S3 to the heating roller 25 in one of the ways described above with reference to FIGS. 3 to 5. Therefore, detailed description of such processing is omitted.

As illustrated in FIG. 6, according to this exemplary embodiment, the processing for reducing the adhesive force which adheres the gloss application sheet S3 to the heating roller 25 is applied to only a part of the contact surface Sb of the gloss application sheet S3 which contacts the heating roller 25. For example, the processing for reducing the adhesive force is applied in a predetermined processing area K, that is, a leading edge portion of the gloss application sheet S3. The processing area K is indicated as a hatched area between a leading edge Sc of the gloss application sheet S3 and a leading edge Jc of the overlay area J in the sheet conveyance direction Y. In other words, the processing for reducing the adhesive force is applied in the processing area K provided downstream from the overlay area J in the sheet conveyance direction Y and connected to the leading edge Sc of the gloss application sheet S3. Thus, the processing area K serves as a non-overlay portion in which the recording sheet P is not overlaid on the gloss application sheet S3.

According to this exemplary embodiment, the processing for reducing the adhesive force is applied only to the processing area K of the gloss application sheet S3 provided beside the leading edge Sc of the gloss application sheet S3 in the sheet conveyance direction Y. In other words, the processing for reducing the adhesive force is applied to a smaller area compared to when the processing for reducing the adhesive force is applied to the whole area of the contact surface Sb of the gloss application sheet S3, thus reducing processing costs. The adhesive force which adheres the gloss application sheet S3 to the heating roller 25 is reduced at least in the processing area K of the gloss application sheet S3 provided beside the leading edge Sc of the gloss application sheet S3 in the sheet conveyance direction Y, effectively suppressing winding of the gloss application sheet S3 around the heating roller 25.

According to this exemplary embodiment, the processing for reducing the adhesive force is applied to the processing area K in which the gloss application sheet S3 does not contact the recording sheet P. Accordingly, the processing for reducing the adhesive force does not adversely affect the recording sheet P with change in physical properties such as thermal conductivity of the gloss application sheet S3, suppressing generation of image noise such as uneven gloss.

Figure 7:
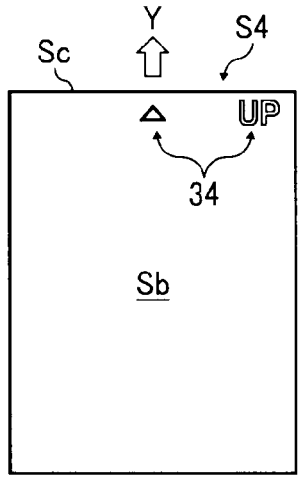
FIG. 7 is a plan view of a gloss application sheet according to yet another exemplary embodiment of the present invention.

Referring to FIG. 7, the following describes a gloss application sheet S4 according to yet another exemplary embodiment. FIG. 7 is a plan view of the gloss application sheet S4. As illustrated in FIG. 7, the gloss application sheet S4 includes markings 34.

The contact surface Sb of the gloss application sheet S4 which contacts the heating roller 25 is applied with the processing for reducing the adhesive force which adheres the gloss application sheet S4 to the heating roller 25 described above by referring to FIGS. 3 to 6. The markings 34 are provided on the contact surface Sb. By contrast, the markings 34 are not provided on the contact surface Sa contacting the image side Pt of the recording sheet P, which is disposed opposite the contact surface Sb contacting the heating roller 25.

For example, two markings are provided on the contact surface Sb of the gloss application sheet S4 as the markings 34 to facilitate identification of the contact surface Sb. One of the two markings is formed of characters UP, and another one of the two markings is formed of a symbol Δ. When a user of the image forming apparatus 100 depicted in FIG. 1 sets the gloss application sheet S4 inside the image forming apparatus 100, the user sets the gloss application sheet S4 in such a manner that the contact surface Sb bearing the markings 34 faces up and the leading edge Sc of the gloss application sheet S4 near which the markings 34 are provided is directed to the fixing nip N in the sheet conveyance direction Y. In other words, the user identifies the contact surface Sb applied with the processing for reducing the adhesive force which adheres the gloss application sheet S4 to the heating roller 25, and sets the gloss application sheet S4 in the proper direction in the image forming apparatus 100. Thus, the user may not misidentify the contact surface Sa as the contact surface Sb, and therefore the gloss application sheet S4 may not be placed upside down.

According to this exemplary embodiment, the markings 34 are formed of the characters and the symbol. Alternatively, the markings 34 may be formed of a numeral or a figure, for example.

Further, according to this exemplary embodiment, the markings 34 are provided on the contact surface Sb only. Alternatively, the markings 34 may be provided on the contact surface Sa. In other words, the markings 34 may be provided on one of the contact surface Sb contacting the heating roller 25 and the contact surface Sa disposed opposite the contact surface Sb to contact the recording sheet P so that the user identifies the contact surfaces Sb and Sa.

Figure 8:
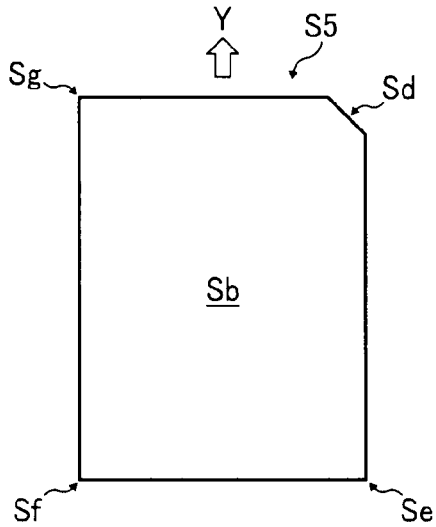
FIG. 8 is a plan view of a gloss application sheet according to yet another exemplary embodiment of the present invention.

Referring to FIG. 8, the following describes a gloss application sheet S5 according to yet another exemplary embodiment. FIG. 8 is a plan view of the gloss application sheet S5. As illustrated in FIG. 8, the gloss application sheet S5 includes corner portions Sd, Se, Sf, and Sg.

In the rectangular gloss application sheet S5 having the four corner portions Sd, Se, Sf, and Sg, one corner portion Sd has a shape different from a shape of the other three corner portions Se, Sf, and Sg. When the user places the gloss application sheet S5 inside the image forming apparatus 100, the corner portion Sd having the different shape from the corner portions Se, Sf, and Sg is directed in the sheet conveyance direction Y in such a manner that the corner portion Sd faces the fixing nip N and is provided on a right edge of the gloss application sheet S5 in FIG. 8. Accordingly, the user can uniquely identify the direction in which the gloss application sheet S5 is set in the image forming apparatus 100. The shape of the gloss application sheet S5 facilitates visual identification of the correct direction in which the gloss application sheet S5 is set in the image forming apparatus 100 by the user. Consequently, the user can easily distinguish the contact surface Sb, which contacts the heating roller 25 and is applied with the processing for reducing the adhesive force which adheres the gloss application sheet S5 to the heating roller 25, from the contact surface Sa disposed opposite the contact surface Sb. In other words, the corner portion Sd serves as an identification portion with which the user distinguishes the contact surface Sb from the contact surface Sa. Thus, the user can set the gloss application sheet S5 in the image forming apparatus 100 in the correct direction. For example, the user does not set the gloss application sheet S5 upside down.

Alternatively, the sheet container 20 (depicted in FIG. 1) for containing the gloss application sheets S5 may be molded to have a shape corresponding to the shape of the gloss application sheets S5 so that the gloss application sheets S5 may not be set in the sheet container 20 unless the user directs the gloss application sheets S5 in the correct direction. Thus, the sheet container 20 having the shape corresponding to the shape of the gloss application sheets S5 prevents incorrect setting of the gloss application sheets S5 in the sheet container 20. Further, the shape of the gloss application sheet S5 is not limited to the shape illustrated in FIG. 8, and may be changed into other shape to provide effects equivalent to the effects provided by the shape illustrated in FIG. 8.

According to the above-described exemplary embodiments, a gloss application sheet (e.g., the gloss application sheet S, S1, S2, S3, S4, or S5 depicted in FIG. 3, 4, 5, 6, 7, or 8, respectively) is not wound around or adhered to a first nip formation member (e.g., the heating roller 25 depicted in FIG. 2). Thus, the gloss application sheet is discharged from a nip (e.g., the fixing nip N) properly. On the other hand, the gloss application sheet is adhered to a recording medium (e.g., the recording sheet P depicted in FIG. 2) properly to form a highly glossy toner image on the recording medium without uneven gloss. Generally, thin sheets have a smaller rigidity, and therefore may be adhered to the first nip formation member. However, with the structure illustrated in FIG. 3, 4, 5, 6, 7, or 8, even thinner sheets than conventional thin gloss application sheets can be separated from the first nip formation member, and heat can be transmitted from the first nip formation member to the recording medium more effectively.

The recording medium is supplied to the nip formed between a pair of nip formation members, that is, the first nip formation member and a second nip formation member (e.g., the pressing roller 26 depicted in FIG. 2) contacting each other. The gloss application sheet enters between the recording medium and one of the pair of nip formation members, that is, the first nip formation member. A first contact surface (e.g., the contact surface Sb depicted in FIG. 3, 4, 5, 6, 7, or 8) of the gloss application sheet which contacts the first nip formation member is processed to reduce an adhesive force which adheres the gloss application sheet to the first nip formation member.

The processing for reducing the adhesive force applied to the first contact surface of the gloss application sheet reduces the adhesive force which adheres the gloss application sheet to the first nip formation member. Accordingly, the gloss application sheet separates from the first nip formation member easily when the gloss application sheet is discharged from the nip. Consequently, the gloss application sheet is not adhered to the first nip formation member.

The first contact surface of the gloss application sheet which contacts the first nip formation member includes a fluorocarbon material or a silicon material.

The fluorocarbon material or the silicon material included in the first contact surface of the gloss application sheet improves releasing property or non-adhesion property of the gloss application sheet to separate from the first nip formation member. Accordingly, the gloss application sheet separates from the first nip formation member easily when the gloss application sheet is discharged from the nip. Consequently, the gloss application sheet is not adhered to the first nip formation member.

The first contact surface of the gloss application sheet which contacts the first nip formation member includes a conductive material.

The conductive material included in the first contact surface of the gloss application sheet reduces an electrostatic attraction force generated between the gloss application sheet and the first nip formation member to attract the gloss application sheet to the first nip formation member. Accordingly, the gloss application sheet separates from the first nip formation member easily when the gloss application sheet is discharged from the nip. Consequently, the gloss application sheet is not adhered to the first nip formation member.

The first contact surface of the gloss application sheet which contacts the first nip formation member is rougher than a second contact surface (e.g., the contact surface Sa depicted in FIG. 3, 4, or 5) of the gloss application sheet disposed opposite the first contact surface.

The first contact surface of the gloss application sheet which is rougher than the second contact surface of the gloss application sheet improves releasing property or non-adhesion property of the gloss application sheet to separate from the first nip formation member. Accordingly, the gloss application sheet separates from the first nip formation member easily when the gloss application sheet is discharged from the nip. Consequently, the gloss application sheet is not adhered to the first nip formation member.

A leading edge portion (e.g., the processing area K depicted in FIG. 6) of the gloss application sheet in a sheet conveyance direction (e.g., the sheet conveyance direction Y depicted in FIG. 6) is applied with the processing for reducing the adhesive force which adheres the gloss application sheet to the first nip formation member.

When the processing for reducing the adhesive force is applied only to the leading edge portion of the gloss application sheet in the sheet conveyance direction, the smaller area on the gloss application sheet is applied with the processing for reducing the adhesive force compared to when the processing for reducing the adhesive force is applied to the whole portion of the gloss application sheet which contacts the first nip formation member, decreasing processing costs. Further, at least the leading edge portion of the gloss application sheet in the sheet conveyance direction reduces the adhesive force which adheres the gloss application sheet to the first nip formation member to suppress adhesion of the gloss application sheet to the first nip formation member effectively.

The leading edge portion of the gloss application sheet applied with the processing for reducing the adhesive force which adheres the gloss application sheet to the first nip formation member is not overlaid on the recording medium.

The processing for reducing the adhesive force is applied to the leading edge portion of the gloss application sheet on which the recording medium is not overlaid. Accordingly, the processing for reducing the adhesive force does not adversely affect the recording medium with change in physical properties of the gloss application sheet caused by the processing for reducing the adhesive force.

A marking (e.g., the markings 34 depicted in FIG. 7) is provided on the first contact surface or the second contact surface of the gloss application sheet to distinguish the first contact surface from the second contact surface of the gloss application sheet.

Accordingly, a user can correctly identify the first contact surface of the gloss application sheet applied with the processing for reducing the adhesive force which adheres the gloss application sheet to the first nip formation member, and may not misplace the gloss application sheet in an image forming apparatus (e.g., the image forming apparatus 100 depicted in FIG. 1).

The gloss application sheet has a shape which distinguishes the first contact surface from the second contact surface.

Accordingly, the user can correctly identify the first contact surface of the gloss application sheet applied with the processing for reducing the adhesive force which adheres the gloss application sheet to the first nip formation member, and may not misplace the gloss application sheet in the image forming apparatus.

The image forming apparatus includes a fixing device (e.g., the fixing device 18 depicted in FIG. 1) including the pair of nip formation members, that is, the first nip formation member and the second nip formation member, contacting each other to form the nip at which heat is applied to the recording medium supplied to the nip to fix a toner image on the recording medium. The image forming apparatus further includes a sheet supplier (e.g., the sheet conveyance roller 21 depicted in FIG. 1) to supply the gloss application sheet between the first nip formation member and the recording medium supplied to the nip. The gloss application sheet has at least one of the structures as described above.

According to the above-described exemplary embodiments, the gloss application sheet S, S1, S2, S3, S4, or S5 is used as a gloss application sheet which is adhered to the recording sheet P to apply gloss to a toner image on the recording sheet P. Alternatively, the structure of the gloss application sheet S, S1, S2, S3, S4, or S5 may be applied to sheets used for other purposes.

The image forming apparatus 100 depicted in FIG. 1 employs a tandem intermediate transfer method for transferring toner images formed on the plurality of photoconductors 2 onto a recording sheet P via the intermediate transfer belt 8. Alternatively, the image forming apparatus 100 may employ other image forming method.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A gloss application sheet for conveyance through a nip formed between a first nip formation member and a second nip formation member pressing against each other in an image forming apparatus, sandwiched between the first nip formation member and a recording medium simultaneously conveyed through the nip, the gloss application sheet comprising:

a first contact surface contacting the first nip formation member; and a second contact surface disposed opposite the first contact surface for contacting the recording medium, the first contact surface having a reduced adhesive force compared to the second contact surface, wherein the first contact surface of the gloss application sheet includes a conductive material.

2. The gloss application sheet according to claim 1, wherein the first contact surface of the gloss application sheet includes one of a fluorocarbon material and a silicon material.

3. The gloss application sheet according to claim 1, further comprising a marking provided on one of the first contact surface and the second contact surface of the gloss application sheet to distinguish the first contact surface from the second contact surface of the gloss application sheet.

4. The gloss application sheet according to claim 1, further comprising an identification portion having a shape to distinguish the first contact surface from the second contact surface of the gloss application sheet.

5. A gloss application sheet for conveyance through a nip formed between a first nip formation member and a second nip formation member pressing against each other in an image forming apparatus, sandwiched between the first nip formation member and a recording medium simultaneously conveyed through the nip, the gloss application sheet comprising:

a first contact surface contacting the first nip formation member; and a second contact surface disposed opposite the first contact surface for contacting the recording medium, the first contact surface having a reduced adhesive force compared to the second contact surface, wherein a surface roughness of the first contact surface is greater than a surface roughness of the second contact surface.

6. The gloss application sheet according to claim 5, wherein the first contact surface of the gloss application sheet includes one of a fluorocarbon material and a silicon material.

7. The gloss application sheet according to claim 5, further comprising an identification portion having a shape to distinguish the first contact surface from the second contact surface of the gloss application sheet.

8. The gloss application sheet according to claim 5, further comprising a marking provided on one of the first contact surface and the second contact surface of the gloss application sheet to distinguish the first contact surface from the second contact surface of the gloss application sheet.

9. A gloss application sheet for conveyance through a nip formed between a first nip formation member and a second nip formation member pressing against each other in an image forming apparatus, sandwiched between the first nip formation member and a recording medium simultaneously conveyed through the nip, the gloss application sheet comprising:

a first contact surface contacting the first nip formation member; and a second contact surface disposed opposite the first contact surface for contacting the recording medium, the first contact surface having a reduced adhesive force compared to the second contact surface, the gloss application sheet further comprising a leading edge portion of the first contact surface of the gloss application sheet in a sheet conveyance direction having a reduced adhesive force compared to all other areas of the gloss application sheet.

10. The gloss application sheet according to claim 9, wherein the first contact surface of the gloss application sheet includes one of a fluorocarbon material and a silicon material.

11. The gloss application sheet according to claim 9, further comprising a marking provided on one of the first contact surface and the second contact surface of the gloss application sheet to distinguish the first contact surface from the second contact surface of the gloss application sheet.

12. The gloss application sheet according to claim 9, further comprising an identification portion having a shape to distinguish the first contact surface from the second contact surface of the gloss application sheet.

13. A gloss application sheet for conveyance through a nip formed between a first nip formation member and a second nip formation member pressing against each other in an image forming apparatus, sandwiched between the first nip formation member and a recording medium simultaneously conveyed through the nip, the gloss application sheet comprising:

a first contact surface contacting the first nip formation member; and a second contact surface disposed opposite the first contact surface for contacting the recording medium, the first contact surface having a reduced adhesive force compared to the second contact surface, the gloss application sheet further comprising a non-overlay portion of the first contact surface of the gloss application sheet on which the recording medium is not overlaid on the gloss application sheet, wherein the non-overlay portion of the gloss application sheet has a reduced adhesive force compared to all other areas of the gloss application sheet.

14. The gloss application sheet according to claim 13, wherein the first contact surface of the gloss application sheet includes one of a fluorocarbon material and a silicon material.

15. The gloss application sheet according to claim 13, further comprising a marking provided on one of the first contact surface and the second contact surface of the gloss application sheet to distinguish the first contact surface from the second contact surface of the gloss application sheet.

16. The gloss application sheet according to claim 13, further comprising an identification portion having a shape to distinguish the first contact surface from the second contact surface of the gloss application sheet.

17. An image forming apparatus comprising:

a fixing device to fix a toner image on a recording medium; and a sheet supplier to supply a gloss application sheet to the fixing device, the fixing device comprising:

a first nip formation member to apply heat to the recording medium bearing the toner image; and a second nip formation member to press against the first nip formation member to form a nip between the first nip formation member and the second nip formation member, the sheet supplier supplying the gloss application sheet between the first nip formation member and the recording medium conveyed through the nip, the gloss application sheet comprising:

a first contact surface contacting the first nip formation member; and a second contact surface disposed opposite the first contact surface for contacting the recording medium, the first contact surface having a reduced adhesive force compared to the second contact surface, wherein the first contact surface of the gloss application sheet includes a conductive material.

* * * * *